US006472647B2

(12) United States Patent
Lee et al.

(10) Patent No.: US 6,472,647 B2
(45) Date of Patent: Oct. 29, 2002

(54) MICROWAVE OVEN WITH RADIANT AND CONVECTIONAL HEATING APPARATUS

(75) Inventors: Sang Ki Lee; Jeong Seob Seo; Kwang Yok Kang, all of Changwon (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/996,966

(22) Filed: Nov. 30, 2001

(65) Prior Publication Data

US 2002/0063125 A1 May 30, 2002

(30) Foreign Application Priority Data

Nov. 30, 2000 (KR) ..... 2000-72172

(51) Int. Cl.[7] ..... H05B 6/80

(52) U.S. Cl. ..... 219/681; 219/757; 219/400; 219/685; 126/21 A

(58) Field of Search ..... 219/681, 685, 219/400, 757; 126/21 A

(56) References Cited

U.S. PATENT DOCUMENTS 6,005,235 A * 12/1999 Shin ..... 219/757

6,323,472 B1 * 11/2001 Coleman ..... 219/685

FOREIGN PATENT DOCUMENTS

| | | | | |
|---|---|---|---|---|
| DE | 30 40 113 | * | 5/1982 | ..... 219/685 |
| JP | 54-58237 | * | 5/1979 | ..... 219/681 |
| JP | 5-52352 | * | 3/1993 | ..... 219/757 |

* cited by examiner

*Primary Examiner*—Philip H. Leung
(74) *Attorney, Agent, or Firm*—Birch, Stewart, Kolasch & Birch, LLP

(57) ABSTRACT

A heating apparatus of a microwave oven includes: an upper plate installed at an upper portion of a cooking chamber into which a cooking object is to be received, having a suction hole for sucking air inside the cooking chamber and a discharge hole for discharging air; a first heater installed at the discharge hole side of the upper plate, for generating convection heat; a second heater disposed in the same enclosure as that of the first heater, for generating radiant heat; and a ventilating fan installed at an upper portion of a region where the suction hole of the upper plate is formed, for circulating air inside the cooking chamber across the first and the second heaters.

5 Claims, 2 Drawing Sheets

MICROWAVE OVEN WITH RADIANT AND CONVECTIONAL HEATING APPARATUS

BACKGROUND OF THE INVENTION

1. Field of the Invention

The present invention relates to a microwave oven, and more particularly, to a heating apparatus of a microwave oven for supplying a heat source other than microwave to a cooking chamber.

2. Description of the Background Art

In general, the microwave oven generates microwaves by using electricity. As the microwaves infiltrate into a cooking object, a movement of molecules is made in the cooking object, according to which the food stuff is heated.

In a case of currently used microwave ovens, since there is a limitations to use of only microwaves as a heat source for heating foodstuff, a heating apparatus is additionally installed to heat foodstuff by using a heating source other than microwaves.

FIG. 1 is a view showing the construction of a microwave oven having a heat apparatus in accordance with conventional art.

The conventional microwave oven includes: a cooking chamber 102 for receiving a cooking object; a tray 104 installed at a lower portion of the cooking chamber 102, being rotated with foodstuff placed thereon; a magnetron (not shown) mounted at one side of the cooking chamber 102, for generating microwaves for heating foodstuff; and a heating apparatus for providing a heat source required for heating foodstuff by a means other than microwaves generated from the magnetron.

Since there are various kinds of cooking objects to be cooked, the heating apparatus includes a first heating system for providing convection heat and a second heating system for providing radiant heat, to provide heat energy suitable to the kind or the property of the cooking object.

The first heating system includes a convection heater 106 disposed at a rear side of the cooking chamber 102, and heating air; and a ventilating fan 108 disposed at the center of the convection heater 106 and circulating the air inside the cooking chamber 102 to pass the convection heater 106.

A suction hole 112 for sucking air inside the cooking chamber 102 and a discharge hole 114 for supplying the air that is heated while passing through the convection heater 106 into the cooking chamber, are formed at the rear side 110 of the cooking chamber 102.

In the first heating system, when the ventilating fan 108 is driven, the air of the cooking chamber is sucked through the suction hole 112, and the sucked air is heated while passing through the convection heater 106 and again supplied into the cooking chamber 102 through the discharge hole 114.

The second heating system includes a grill heater 118 disposed at certain intervals at the upper portion of the cooking chamber 102, for generating radiant heat to directly heat the cooking object.

As stated above, as for the heating apparatus of a microwave oven in accordance with the conventional art, the first heating system is operated when convection heat is required according to the kind and the property of the cooking object to be cooked. That is, when the ventilating fan 108 is driven, air is circulated in the horizontal direction of the cooking chamber as indicated in the arrows 'A' as shown in FIG. 1, heating the cooking object.

Meanwhile, in case radiant heat is required, the cooking object is heated by a radiant heat generated from the grill heater 118 mounted at the upper portion of the cooking chamber.

However, the conventional heating apparatus of microwave oven has the following problems.

That is, since the first heating system for generating a convection heat and the second heating system for generating the radiant heat are separately mounted at the rear side and the upper portion of the cooking chamber, the installation space is much occupied, enlarging the size of the whole system, and since additional components are required, its production cost is increased according to the increase in the number of components.

In addition, since the radiant heat of the grill heater is circulated in the horizontal direction of the cooking chamber, heat transmittance to the cooking object is not desirable, resulting in degradation of heat efficiency, and accordingly, the cooking quality of foodstuff is degraded and the cooking speed is slow.

SUMMARY OF THE INVENTION

Therefore, an object of the present invention is to provide a heating apparatus of a microwave oven that is capable of reducing the size of a system by considerably reducing installation space by integrating a heating system for generating radiant heat and a heating system for generating convection heat and installing it at the upper portion of a cooking chamber, and capable of reducing production cost by reducing the number of components.

Another object of the present invention is to provide a heating apparatus of a microwave oven that is capable of improving heat efficiency as air is circulated vertically from the center of a cooking chamber in a case of using radiant heat, and capable of improving cooking quality of a cooking object and shortening the cooking speed by evenly transmitting heat to the cooking object.

To achieve these and other advantages and in accordance with the purpose of the present invention, as embodied and broadly described herein, there is provided a heating apparatus of a microwave oven including: an upper plate installed at an upper portion of a cooking chamber into which a cooking object is to be received, having a suction hole for sucking air inside the cooking chamber and a discharge hole for discharging air; a first heater installed at the discharge hole side of the upper plate, for generating convection heat; a second heater disposed in the same space as that of the first heater, for generating a radiant heat; and a ventilating fan installed at an upper portion of a region where the suction hole of the upper plate is formed, for circulating air inside the cooking chamber through the first and the second heaters.

The heating apparatus of a microwave oven of the present invention further includes an air guide fixed to cover the ventilating fan and the first and the second heaters at the upper side of the upper plate, for guiding air flow from the ventilating fan to the first and the second heaters.

The heating apparatus of a microwave oven of the present invention further includes a heater housing in which the first and the second heater are inserted and an air passage is formed at its upper side to supply air from the ventilating fan to the first and the second heaters.

In the heating apparatus of a microwave oven of the present invention, both ends of the first heater are fixed at the heater housing, and the first heater is formed in a bar type bent for several times to enlarge the area within which air passes.

In the heating apparatus of a microwave oven of the present invention, the second heater is disposed at the upper side of the first heater with a certain distance therebetween, of which both ends are fixed at the heater housing.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

There may be a plurality of embodiments of a microwave oven of the present invention, of which the most preferred embodiment will now be described.

Figure 1:
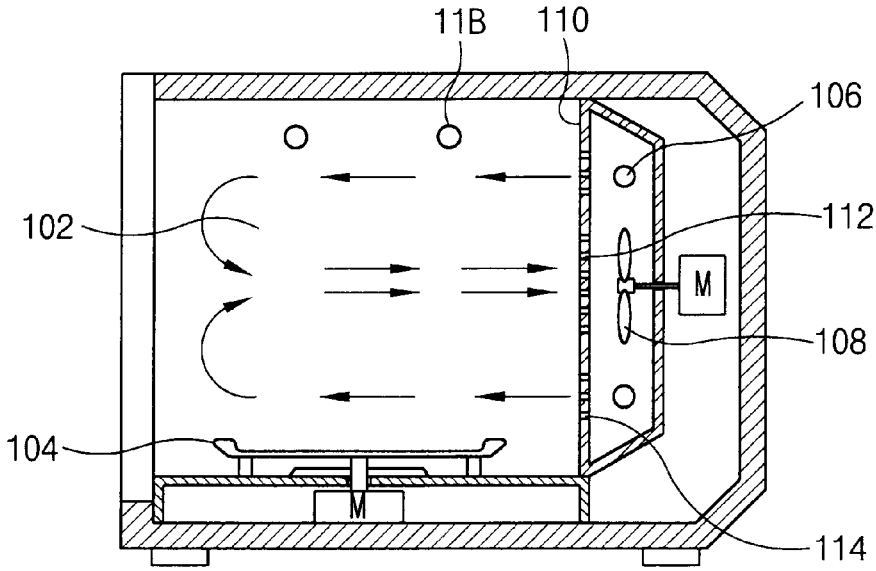
FIG.1 BACKGROUND ART
FIG. 1 is a schematic sectional view showing a microwave oven having a heating apparatus in accordance with a conventional art.
Figure 2:
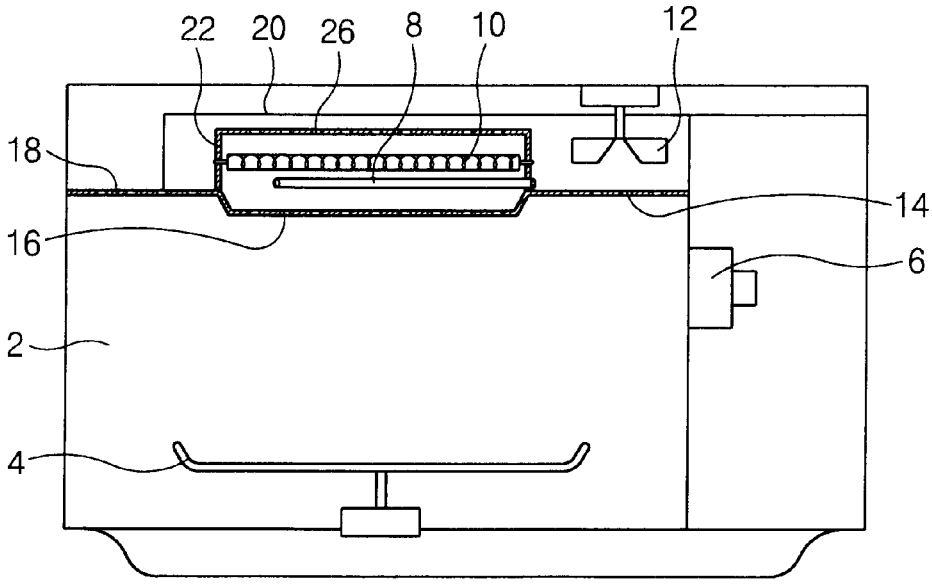
FIG. 2 is a schematic sectional view showing a microwave oven having a heating apparatus in accordance with a preferred embodiment of the present invention.
Figure 3:
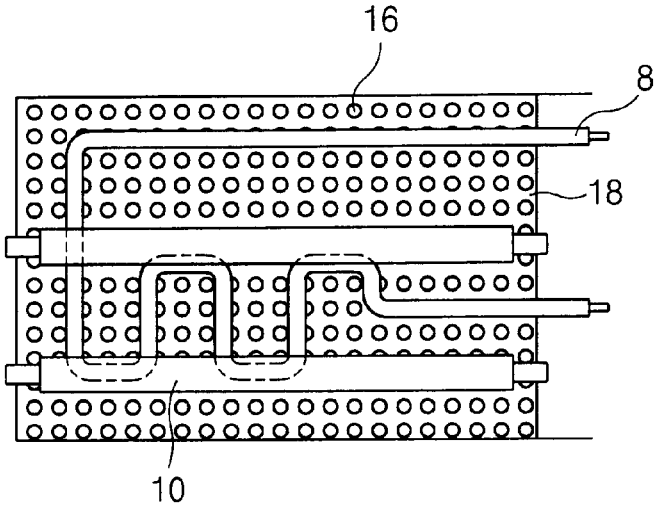
FIG. 3 is a front view showing a heater installation structure of the heating apparatus of a microwave oven in accordance with the preferred embodiment of the present invention.

FIG. 2 is a schematic sectional view showing a microwave oven having a heating apparatus in accordance with a preferred embodiment of the present invention, and FIG. 3 is a front view showing a heater installation structure of the heating apparatus of a microwave oven in accordance with the preferred embodiment of the present invention.

A microwave oven having a heating apparatus in accordance with a present invention includes a cooking chamber 2 for receiving foodstuff; a tray 4 installed at a lower portion of the cooking chamber, being rotated with foodstuff mounted thereon, a magnetron 6 for generating microwaves for heating foodstuff; and a heating apparatus installed at the upper portion of the cooking chamber 2, for providing foodstuff with convection heat or radiant heat.

The heating apparatus includes a first heater 8 disposed at an upper portion of the cooking chamber 2, for generating convection heat; a second heater 10 disposed at the same space as that of the first heater 8, for generating radiant heat; a ventilating fan 12 disposed at one side of the upper portion of the cooking chamber 2, for circulating air inside the cooking chamber 2 to pass the first and the second heaters 8 and 10; and an upper plate 18 installed, including the ventilating fan 12 and the first and the second heaters 8 and 10 therein, at the upper portion of the cooking chamber, having a suction hole 14 for sucking air of the cooking chamber 2 and a discharge hole 16 for discharging heated air to the cooking chamber 2.

An air guide 20 is installed at the upper side of the upper plate 18, covering the ventilating fan 12 and the first and the second heaters 8 and 10, so as to guide air flow from the ventilating fan 12 to the first and the second heaters 8 and 10.

A heater housing 22 is installed at the upper side of the first and the second heaters 8 and 10.

The first and the second heaters 8 and 10 are disposed in the same area at the center of the cooking chamber but different in their types: as the first heater 8, any heater can be adopted as long as it generates a convection heat, and as the second heater 10, any heater can be adopted as long as it generates radiant heat.

The first heater 8 is disposed at the upper portion of the cooking chamber 2 in a state of being inserted in the heater housing 22, and is formed in a bar type which is bent several times so as to enlarge an area that air passes.

The second heater 10 is disposed at the upper side of the first heater 8 at a certain distance, for providing a radiant heat into the cooking chamber 2 through the discharge hole. Both ends of there of are fixed at both sides of the heater housing 22, and the number of heaters installed is controlled according to the area to be heated.

The ventilating fan 12 is mounted at a portion where the suction hole 14 of the upper plate is formed, so as to provide a ventilating force by which the air inside the cooking chamber 2 is sucked through the suction hole 14, passes the first and the second heater 8 and 10 and discharged to the discharge hole 16.

The upper plate 18 is mounted to compartmentalize the space at the upper portion of the cooking chamber 2.

The discharge hole 16 is formed at the center of the upper plate 18, for discharging air heated while passing over the first heater 8 into the cooking chamber 2 and providing the radiant heat of the second heater 10 to the inside of the cooking chamber 2.

The suction hole 14 is formed at one side of the marginal portion of the upper plate 18, to suck the air out of the cooking chamber.

The air guide 20 is formed with its one side opened and fixed in a manner that its opened face covers the heater and the ventilating fan 12 at the upper side face of the upper plate 18, so that the air sucked by the ventilating fan 12 can be smoothly guided to flow toward the heaters 8 and 10.

The heater housing 22 is installed to cover the first and the second heaters 8 and 10 at the inner side of the air guide 20, and at an upper side thereof, an air passage 26 for supplying air guided by the air guide 20 to the first and the second heaters 8 and 10 is formed.

Figure 4:
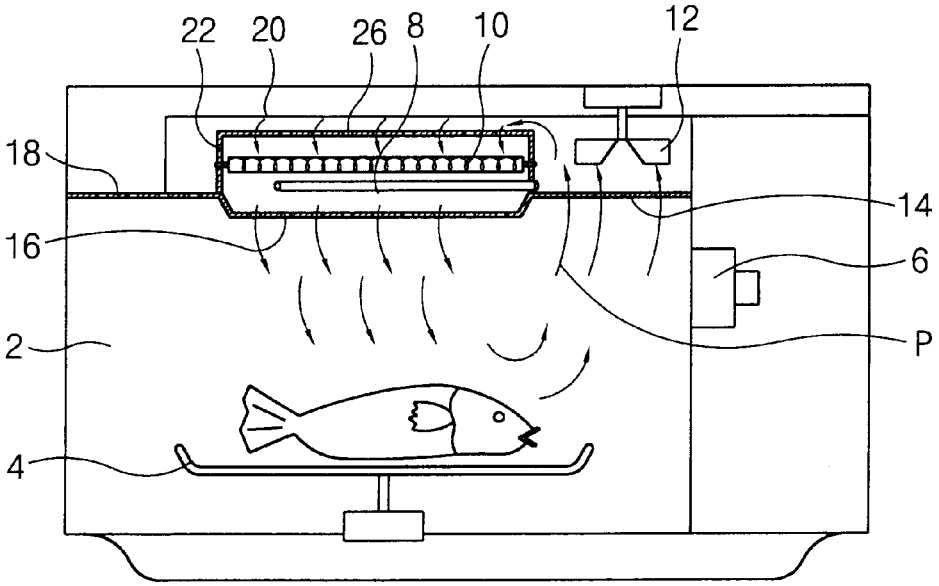
FIG. 4 is a view showing an operational state of the heating apparatus of a microwave oven in accordance with the preferred embodiment of the present invention.

FIG. 4 is a view showing an operational state of the heating apparatus of a microwave oven in accordance with the preferred embodiment of the present invention.

As shown in FIG. 4, first, in case that a cooking object is heated by using the convection heat, the ventilating fan 12 is driven and power is supplied to the first heater 8.

That is, when the ventilating fan 12 is driven, air inside the cooking chamber is sucked into the air guide 20 through the suction hole 14.

The thusly sucked air is guided by the air guide 20, introduced into the first heater 8 through the air passage 26 and heated while passing the first heater 8.

The air heated while passing the first heater 8 flows into the cooking chamber through the discharge hole 16.

The air introduced into the cooking chamber 2 heats the cooking object, and the air which has completed heating is sucked into the suction hole 14. That is, the air inside the cooking chamber heats the foodstuff while circulating in the vertical direction as shown with the arrow 'P'.

Meanwhile, in a case of heating the cooking object by using the radiant heat, the second heater 10 and the ventilating fan 12 are operated. That is, the radiant heat generated from the second heater 12 is supplied into the cooking chamber 2 through the discharge hole 16, to heat the cooking object.

At this time, since the ventilating fan 12 is operated, air passing the second heater 10 is heated and supplied into the cooking chamber 2, so that the convection heat works simultaneously works.

On the other hand, in a case that radiant heat and convection heat are required together depending on the kinds of the cooking object, the first heater 8 and the second heater 10 are simultaneously operated to provide the convection heat of the first heater 8 and the radiant heat of the second heater 10 to the cooking object.

In this manner, when the radiant heat and the convection heat are simultaneously supplied into the cooking chamber, the temperature of the cooking chamber goes. up quickly, so that the cooking speed can be quickened.

As so far described, the heating apparatus of a microwave oven according to the present invention has many advantages.

For example, first, since the first heater generating the radiant heat and the second heater generating the convection heat are inserted in the heater housing which is installed at the upper portion of the cooking chamber, the installation space is considerably reduced. Accordingly, the system can be compact, and accordingly as the number of components is reduced, its fabrication cost can be reduced.

Secondly, in case that foodstuff is cooked by using the radiant heat generated from the second heater, air is circulated in the vertical direction from the center of the cooking chamber, so that heat efficiency can be improved. In addition, since the heat is uniformly transmitted to the cooking object, a cooking quality can be improved and cooking time can be shortened.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A heating apparatus of a microwave oven comprising:

an upper plate installed at an upper portion of a cooking chamber into which a cooking object is to be received, having a suction hole for sucking air inside the cooking chamber and a discharge hole for discharging air;

a first heater installed within an inner heater housing, at the discharge hole side of the upper plate, for generating convection heat;

a second heater disposed within the inner heater housing, for generating radiant heat; and a ventilating fan installed at an upper portion of a region where the suction hole of the upper plate is formed, inside of an air guide and outside of said inner heater housing, for re-circulating air inside the cooking chamber across the first and the second heaters.

2. The apparatus of claim 1, wherein an air guide fixed to cover the ventilating fan and the first and the second heaters at the upper side of the upper plate, for guiding air flow from the ventilating fan to the first and the second heaters.

3. The apparatus of claim 1, wherein a heater housing in which the first and the second heaters are inserted and an air passage is formed at its upper side to supply air from the ventilating fan to the first and the second heaters.

4. The apparatus of claim 1, wherein both ends of the first heater are fixed at the heater housing, and the first heater is formed in a bar type bent for several times to enlarge the area that air passes.

5. The apparatus of claim 1, wherein the second heater is disposed at the upper side of the first heater with certain intervals, and both of its ends are fixed at the heater housing.

* * * * *